US010364991B2

(12) United States Patent
Kang et al.

(10) Patent No.: US 10,364,991 B2
(45) Date of Patent: Jul. 30, 2019

(54) OVEN

(71) Applicant: SAMSUNG ELECTRONICS CO., LTD., Suwon-si (KR)

(72) Inventors: Han Seong Kang, Hwasung-si (KR); Hyang Ki Kim, Suwon-si (KR); Sang Yun Jung, Suwon-si (KR); Seok Weon Hong, Yongin-si (KR); Yun Ic Hwang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 837 days.

(21) Appl. No.: 14/041,634

(22) Filed: Sep. 30, 2013

(65) Prior Publication Data

US 2014/0097172 A1 Apr. 10, 2014

(30) Foreign Application Priority Data

Oct. 8, 2012 (KR) ..... 10-2012-0111441

(51) Int. Cl.
*F24C 11/00* (2006.01)
*F24C 15/02* (2006.01)
*F24C 7/00* (2006.01)

(52) U.S. Cl.
CPC ..... *F24C 11/00* (2013.01); *F24C 7/002* (2013.01); *F24C 15/02* (2013.01); *F24C 15/023* (2013.01); *F24C 15/028* (2013.01)

(58) Field of Classification Search
CPC ..... A61K 2039/55544; A61K 39/12; A61K 39/21; C07K 14/005; C07K 2319/01;
(Continued)

(56) References Cited

U.S. PATENT DOCUMENTS 892,187 A * 6/1908 Schriefer ..... A47B 87/02 217/65
1,209,326 A 12/1916 Nye
(Continued)

FOREIGN PATENT DOCUMENTS

CN 101548854 A 10/2009
DE 33 26 895 A1 2/1985
(Continued)

OTHER PUBLICATIONS

European Search Report dated Feb. 24, 2014 and issued in corresponding European Patent Application 13185757.5-1605.
(Continued)

*Primary Examiner* — Tu B Hoang
*Assistant Examiner* — Diallo I Duniver
(74) *Attorney, Agent, or Firm* — Staas & Halsey LLP

(57) ABSTRACT

An oven in which a cooking space in a cooking chamber is dividable into a plurality of individual cooking spaces by a partition member. The oven includes a door assembly including a main door rotatably combined with a main body and provided with a plurality of openings corresponding to the respective plurality of individual cooking spaces and a plurality of individual doors rotatably combined with the main body to open and close the respective plurality of openings. The door assembly may selectively open and close the entirety of the cooking space or the respective plurality of individual cooking spaces, and thus a heat loss or danger of burn generated due to opening and closing the main door when only the individual cooking space is used may be prevented.

13 Claims, 12 Drawing Sheets

(58) Field of Classification Search
CPC ..... C12N 2740/16034; C12N 2740/16071; C12N 2740/16322; C12N 2740/16334; C12N 7/00; F24C 11/00; F24C 15/02; F24C 15/023; F24C 15/028; F24C 7/002; F24C 15/021; F24C 15/022; F24C 15/024; F24C 15/025; F24C 15/026; F24C 15/027; F24C 15/04; F24C 15/045; F24C 15/06; B64C 1/14; B64D 11/00
USPC ..... 219/394, 190–200; 424/188.1, 185.1; 126/190, 194, 197; 530/324, 300, 322, 530/325, 326, 327, 328, 329; 99/482, 99/448, 449, 444, 450; 49/169, 165, 161, 49/166, 168, 162, 170–177, 158; 244/129.5, 118.5, 121
See application file for complete search history.

(56) References Cited

U.S. PATENT DOCUMENTS 1,398,725 A 11/1921 Kneier
1,530,007 A * 3/1925 Moore ..... F24C 15/023 126/190
2,815,018 A * 12/1957 Collins ..... F24C 15/02 126/190
4,149,518 A 4/1979 Schmidt et al.
4,875,745 A * 10/1989 Trulaske ..... E05C 7/005 312/109
5,618,458 A * 4/1997 Thomas ..... F24C 3/124 126/194
6,698,690 B2 * 3/2004 Novak ..... B64C 1/1423 244/118.5
6,945,497 B2 * 9/2005 Saku ..... B64C 1/1469 244/118.5
2008/0078373 A1 * 4/2008 Kim ..... F24C 15/022 126/192
2012/0019112 A1 1/2012 Steurer

FOREIGN PATENT DOCUMENTS

GB 251478 5/1926
GB 2 323 439 A 9/1998
KR 10-2004-0046467 6/2004
KR 10-2008-0029202 4/2008
KR 10-2011-0055076 5/2011

OTHER PUBLICATIONS

Chinese Office Action dated Dec. 30, 2016 in corresponding Chinese Patent Application No. 201310463668.5.
Chinese Office Action dated Sep. 22, 2017 in corresponding Chinese Patent Application No. 201310463668.5.
Office Action dated Apr. 11, 2018, in corresponding Chinese Patent Application No. 201310463668.5, 19 pgs.
European Search Report issued Communication pursuant to Article 94(3) EPC in Application No. 13185757.5 dated Nov. 30, 2018 (8 pages).
Chinese Patent Office Action issued *Notification of Fulfilling of Registration Formality* in Chinese Patent Application No. 201310463668.5 dated Sep. 26, 2018 (5 total pages).
Korean Patent Office Action issued in Korean Patent Application No. 10-2012-0111441 dated Jul. 20, 2018 (total of 25 pages).
Chinese Patent Office issued Notice of Allowance in Chinese Patent Application No. 9-5-2019-002661618 dated Jan. 10, 2019 (3 pages total).

* cited by examiner

OVEN

CROSS-REFERENCE TO RELATED APPLICATIONS

This application claims the priority benefit of Korean Patent Application No. 10-2012-0111441, filed on Oct. 8, 2012 in the Korean Intellectual Property Office, the disclosure of which is incorporated herein by reference.

BACKGROUND

1. Field

The following description relates to an oven in which a cooking space in a cooking chamber is dividable into a plurality of individual cooking spaces by a partition member.

2. Description of the Related Art

In general, an oven is an electric home appliance which includes a cooking chamber having a cooking space and a heating device providing heat to the cooking space, and cooks food using heat.

Among ovens, there is an oven provided with a partition member arranged in a cooking space to divide the cooking space and to divide the cooking space into a plurality of individual cooking spaces. Separate heating devices are provided in the respective individual cooking spaces, and the respective heating devices may be independently controlled.

Therefore, when food having a small size is cooked, a user may operate one individual cooking space instead of operating the entirety of the cooking space, thus reducing power consumption. Of course, when food having a large size requiring use of the entirety of the cooking space is cooked, the entirety of the cooking space may be operated by removing the partition member.

In such an oven in which the entirety of the cooking space or the individual cooking space having a smaller size than the entirety of the cooking space may be flexibly used, a door opening and closing the cooking space requires an improved structure so as to cover the entirety of the cooking space or the individual cooking space.

SUMMARY

Therefore, it is an aspect of the present disclosure to provide an oven in which the entirety of a cooking space is used or individual cooking spaces divided from the cooking space are selectively used, and has a door structure selectively opening and closing the entirety of the cooking space or the individual cooking spaces.

Additional aspects of the disclosure will be set forth in part in the description which follows and, in part, will be apparent from the description, or may be learned by practice of the disclosure.

In accordance with one aspect of the present disclosure, an oven includes a main body, a cooking chamber provided within the main body and including a cooking space, a partition member to divide the cooking space into a first individual cooking space and a second individual cooking space, and a door assembly including a main door provided with a first opening corresponding to the first individual cooking space and a second opening corresponding to the second individual cooking space and rotatably combined with the main body, a first individual door rotatably combined with the main door so as to open and close the first opening, and a second individual door rotatably combined with the main door so as to open and close the second opening.

The partition member may be detachably installed in the cooking space.

A first mode in which the entirety of the cooking space is operated under the condition that the partition member is separated from the cooking space, a second mode in which the first individual cooking space and the second individual cooking space are operated under the condition that the partition member is installed in the cooking space, a third mode in which only the first individual cooking space is operated and the second individual cooking space is not operated under the condition that the partition member is installed in the cooking space, and a fourth mode in which the first individual cooking space is not operated and only the second individual cooking space is operated under the condition that the partition member is installed in the cooking space may be prepared, the main door may be opened and closed under the condition that the first individual door and the second individual door are closed in the first mode, the main door may be opened and closed under the condition that the first individual door and the second individual door are closed or the first individual door and the second individual door may be opened and closed under the condition that the main door is closed in the second mode, the first individual door may be opened and closed under the condition that the main door and the second individual door are closed in the third mode, and the second individual door may be opened and closed under the condition that the main door and the first individual door are closed in the fourth mode.

The oven may further include a main sealing member closely adhered to the main body and the main door so as to hermetically seal the cooking space, a first sealing member closely adhered to the main door and the first individual door so as to hermetically seal the first opening, and a second sealing member closely adhered to the main door and the second individual door so as to hermetically seal the second opening.

The oven may further include a plurality of main hinge devices to rotatably combine the main door with the main body, a plurality of first hinge devices to rotatably combine the first individual door with the main door, and a plurality of second hinge devices to rotatably combine the second individual door with the main body.

The oven may further include a first locking device to lock the first individual door with the main door and a second locking device to lock the second individual door with the main door.

A main handle may be provided on the main door, a first handle may be provided on the first individual door, a second handle may be provided on the second individual door, when the main handle is pulled, the main door may be opened, when the first handle is pulled, the first individual door may be opened, and when the second handle is pulled, the second individual door may be opened.

Further, a main handle may be provided on the main door, a separate handle may not be provided on the first individual door, a separate handle may not be provided on the second individual door, when the main handle is pulled, the main door may be opened, when the first individual door is pushed at a first predetermined force, the first individual door may be opened, and when the second individual door is pushed at a second predetermined force, the second individual door may be opened.

Further, a separate handle may not be provided on the main door, a first handle may be provided on the first individual door, a second handle may be provided on the second individual door, when the first handle is pulled under the condition that the first individual door is locked with the main door, the main door may be opened, when the first handle is pulled under the condition that the first individual door is unlocked with the main door, the first individual door may be opened, and when the second handle is pulled, the second individual door may be opened.

The first locking device may include a plurality of hook members rotatably provided on the first individual door, a plurality of holes provided on the main door so as to correspond to the plurality of hook members, a plurality of first elastic members to elastically bias the plurality of hook members to be locked with the plurality of holes, a opening member provided on the first handle so as to rotate the plurality of hook members in a releasing direction of the locking of the plurality of hook members to the plurality of holes, connection members to connect the opening member to the plurality of the plurality of hook members so as to rotate the plurality of hook members when the opening member is pressed, and a second elastic member provided on the first handle so as to return the opening member to the original position thereof when pressing of the opening member is released, wherein, when the opening member is not pressed, the first individual door is locked with the main door, and, when the opening member is pressed, the first individual door is unlocked with the main door.

The connection members may be wires.

In accordance with another aspect of the present disclosure, an oven includes a main body, a cooking chamber provided within the main body and including a cooking space, a partition member to divide the cooking space into a plurality of individual cooking spaces, a main door rotatably combined with the main body so as to open and close an opened front surface of the cooking space, a plurality of openings formed on the main door so as to respectively approach the plurality of individual cooking spaces without opening of the main door, and a plurality of individual doors rotatably combined with the main door so as to respectively open and close the plurality of openings.

In accordance with a further aspect of the present disclosure, an oven includes a main body, a cooking chamber provided within the main body and including a cooking space, a partition member to divide the cooking space into a first individual cooking space and a second individual cooking space, a plurality of first doors combined with both side portions of the main body and rotatable in the leftward and rightward directions so as to open and close the first individual cooking space, and a plurality of second doors combined with both side portions of the main body and rotatable in the leftward and rightward directions so as to open and close the second individual cooking space.

Here, at least one of the plurality of first doors may be combined with one side portion of the main body and rotatable in the leftward and rightward directions so as to open and close at least a portion of the first individual cooking space, the other one of the at least one of the plurality of first doors may be combined with the other side portion of the main body and rotatable in the leftward and rightward directions so as to open and close the remaining portion of the first individual cooking space, at least one of the plurality of second doors may be combined with one side portion of the main body and rotatable in the leftward and rightward directions so as to open and close at least a portion of the second individual cooking space, and the other one of the at least one of the plurality of second doors may be combined with the other side portion of the main body and rotatable in the leftward and rightward directions so as to open and close the remaining portion of the second individual cooking space.

The partition member may be detachably installed in the cooking space.

A first mode in which the entirety of the cooking space is operated under the condition that the partition member is separated from the cooking space, a second mode in which the first individual cooking space and the second individual cooking space are operated under the condition that the partition member is installed in the cooking space, a third mode in which only the first individual cooking space is operated and the second individual cooking space is not operated under the condition that the partition member is installed in the cooking space, and a fourth mode in which the first individual cooking space is not operated and only the second individual cooking space is operated under the condition that the partition member is installed in the cooking space may be prepared, the plurality of first doors and the plurality of second doors may be opened and closed in the first mode and the second mode, the plurality of first doors may be opened and closed under the condition that the plurality of second doors is closed in the third mode, and the plurality of second doors may be opened and closed under the condition that the plurality of first doors is closed in the fourth mode.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
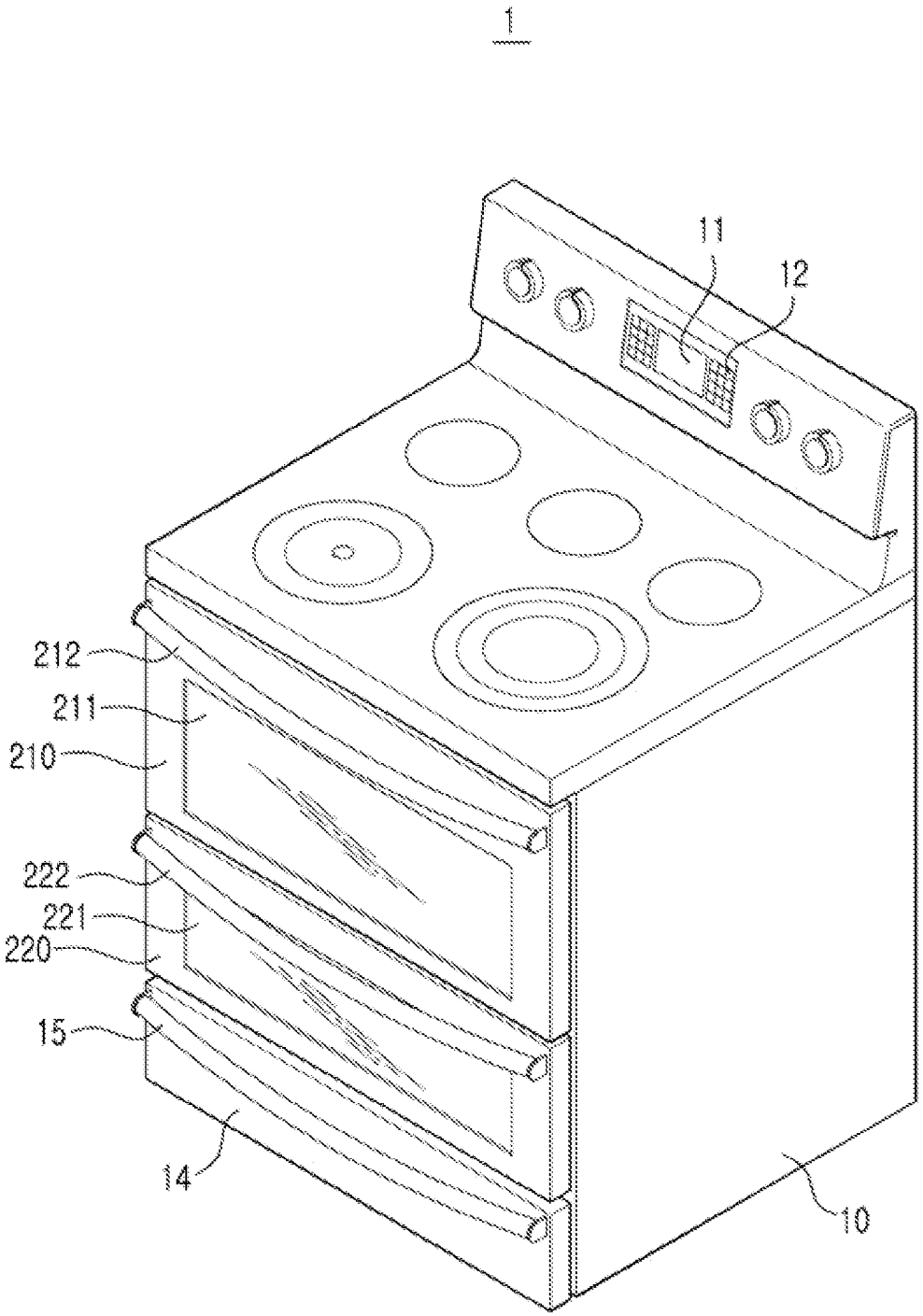
FIG. 1 is a view illustrating an oven in accordance with an embodiment of the present disclosure in a state in which a main door is closed.

Reference will now be made in detail to embodiments of the present disclosure, examples of which are illustrated in the accompanying drawings, wherein like reference numerals refer to like components throughout.

Figure 2:
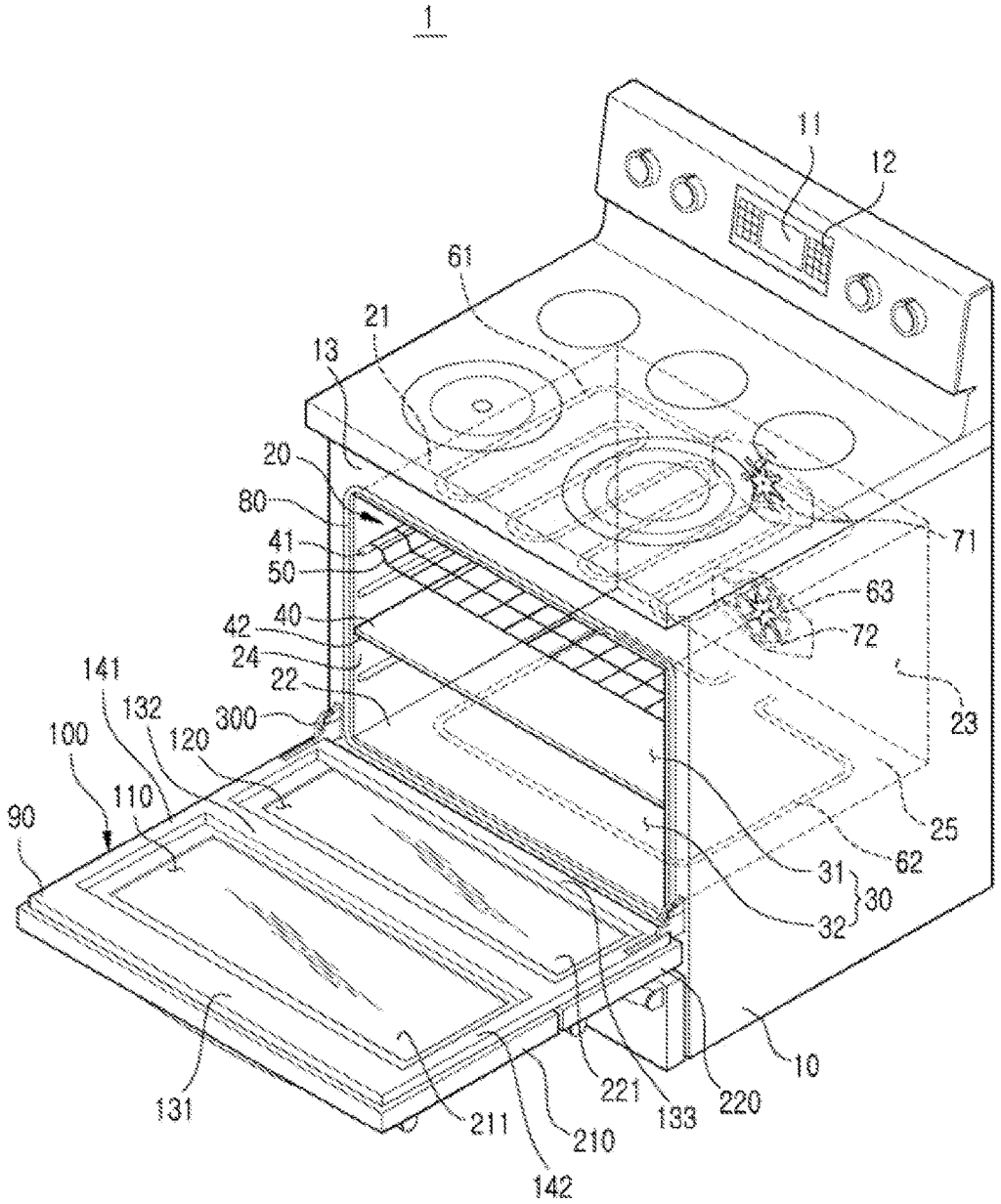
FIG. 2 is a view illustrating the oven of FIG. 1 in a state in which the main door is opened.
Figure 3:
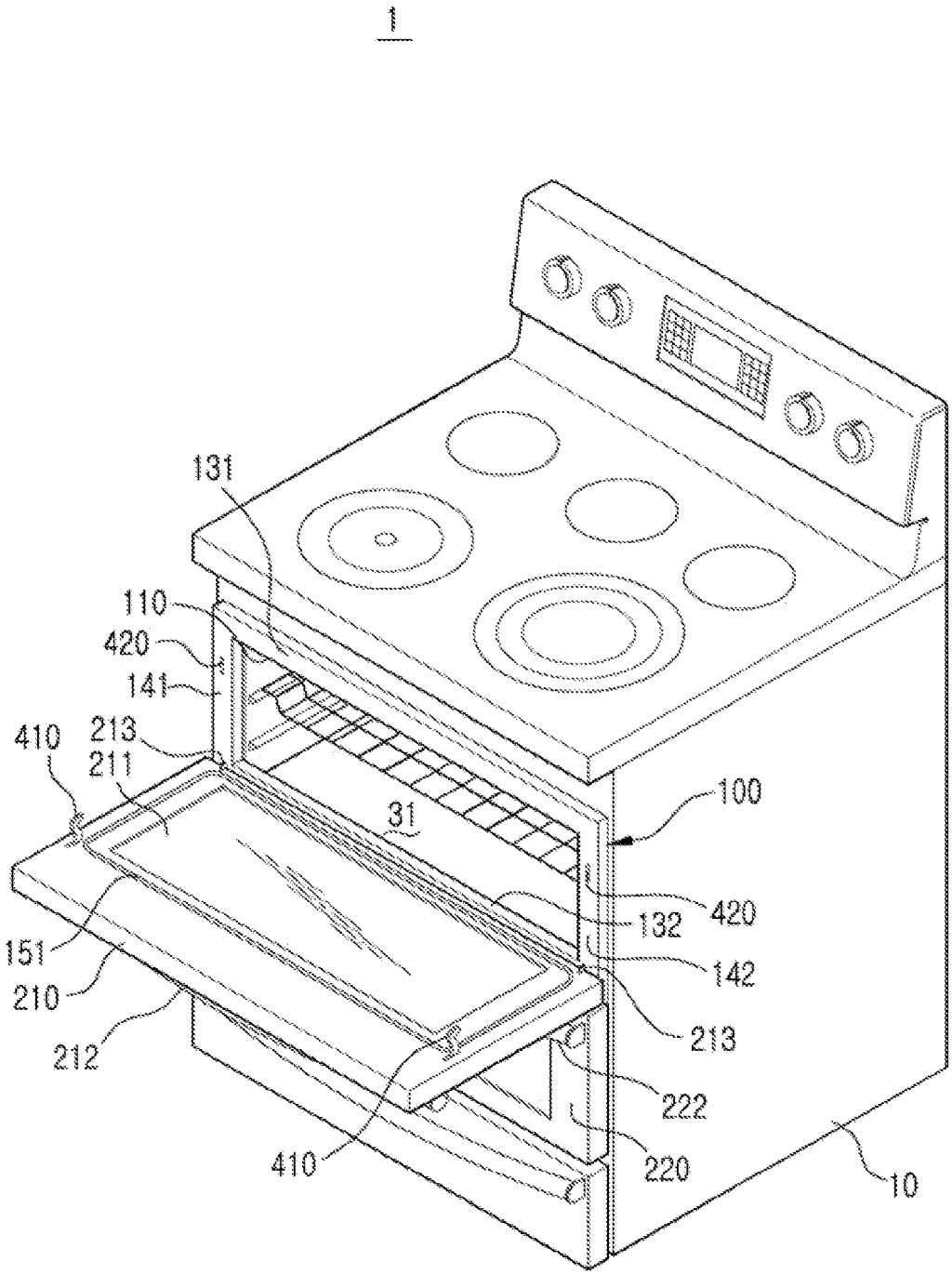
FIG. 3 is a view illustrating the oven of FIG. 1 in a state in which a first individual door is opened.
Figure 4:
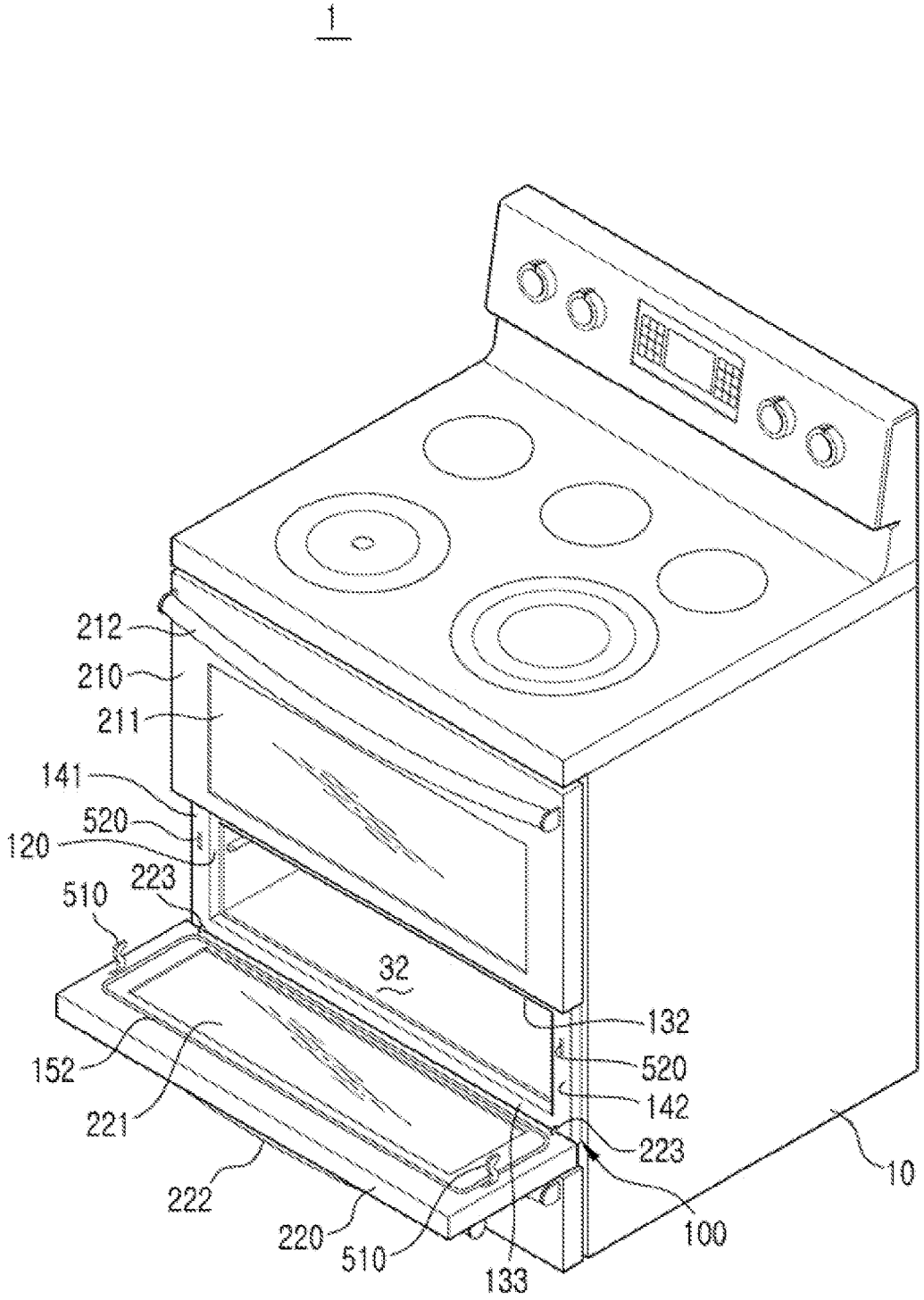
FIG. 4 is a view illustrating the oven of FIG. 1 in a state in which a second individual door is opened.
Figure 5:
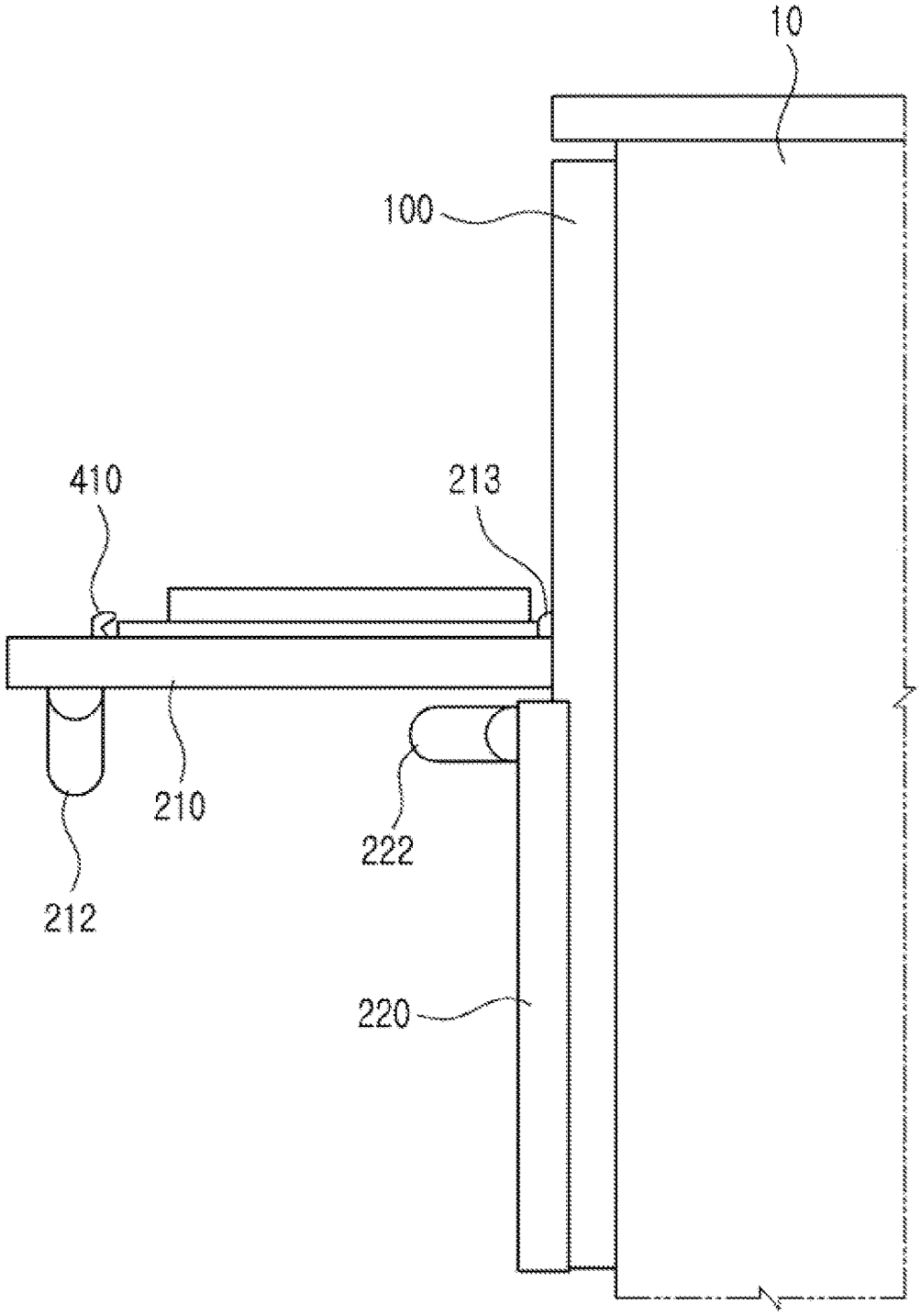
FIG. 5 is a side view illustrating the oven of FIG. 1 in the state in which the second individual door is opened.
Figure 6:
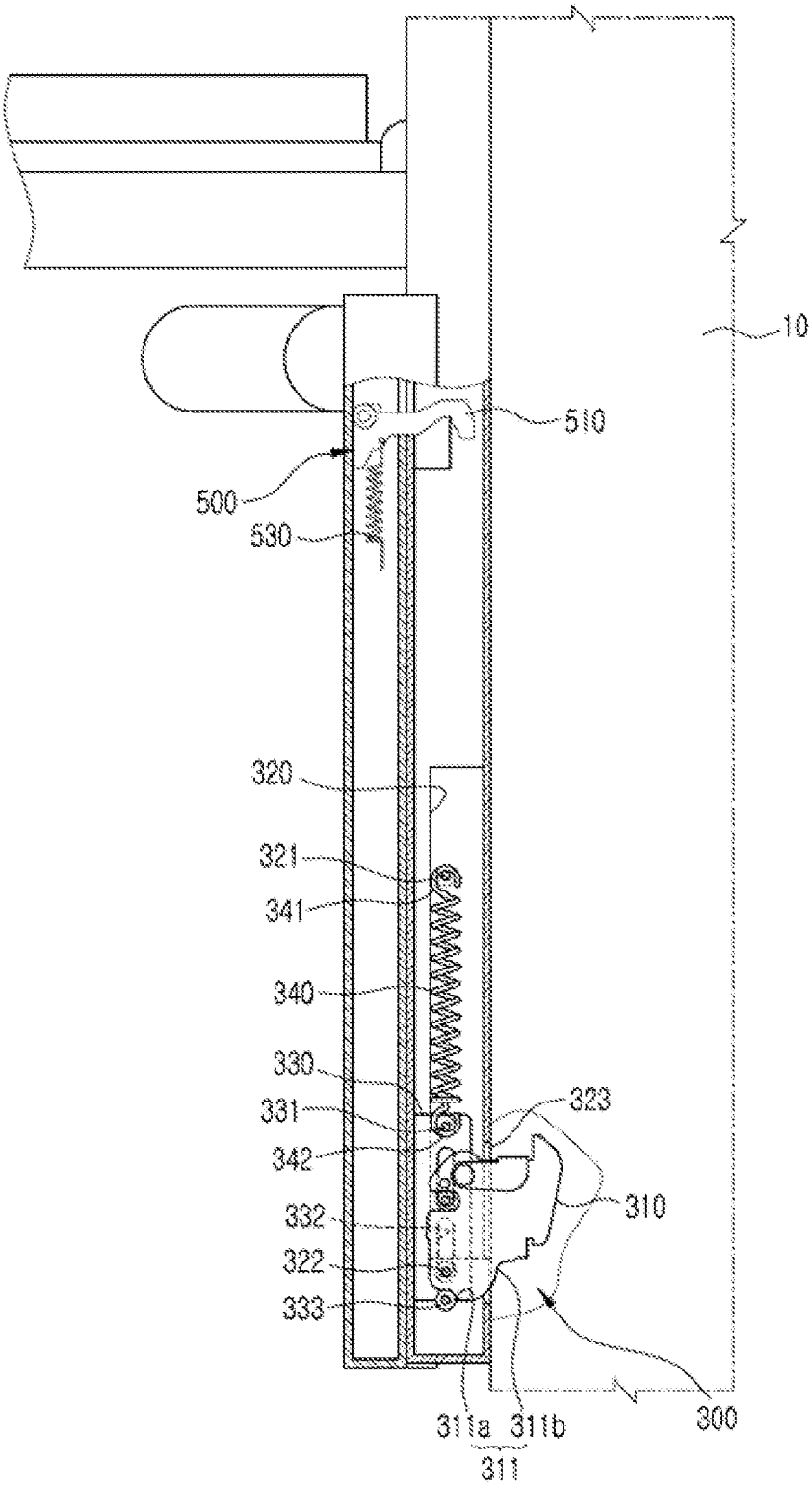
FIG. 6 is a longitudinal-sectional view illustrating the oven of FIG. 1 in the state in which the second individual door is opened.
Figure 7:
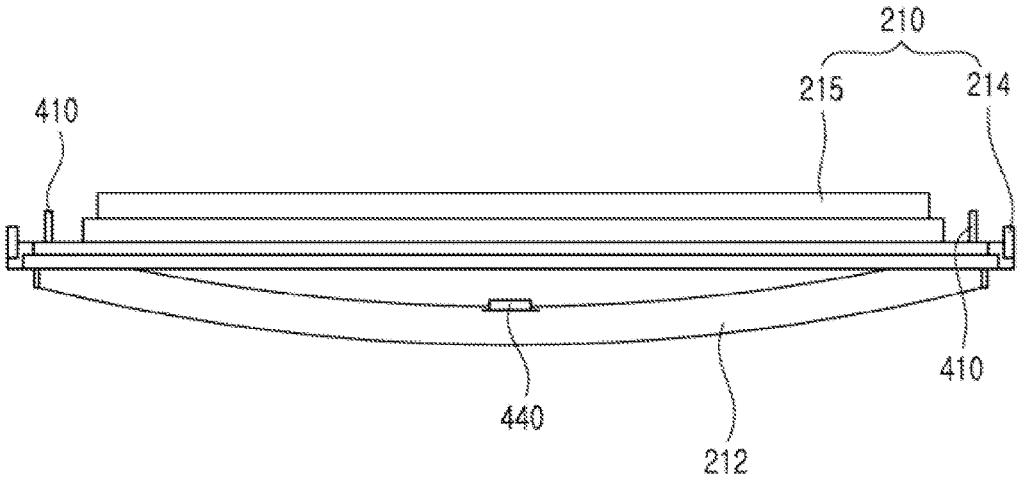
FIG. 7 is a view illustrating the first individual door and a first handle of the oven of FIG. 1.
Figure 8:
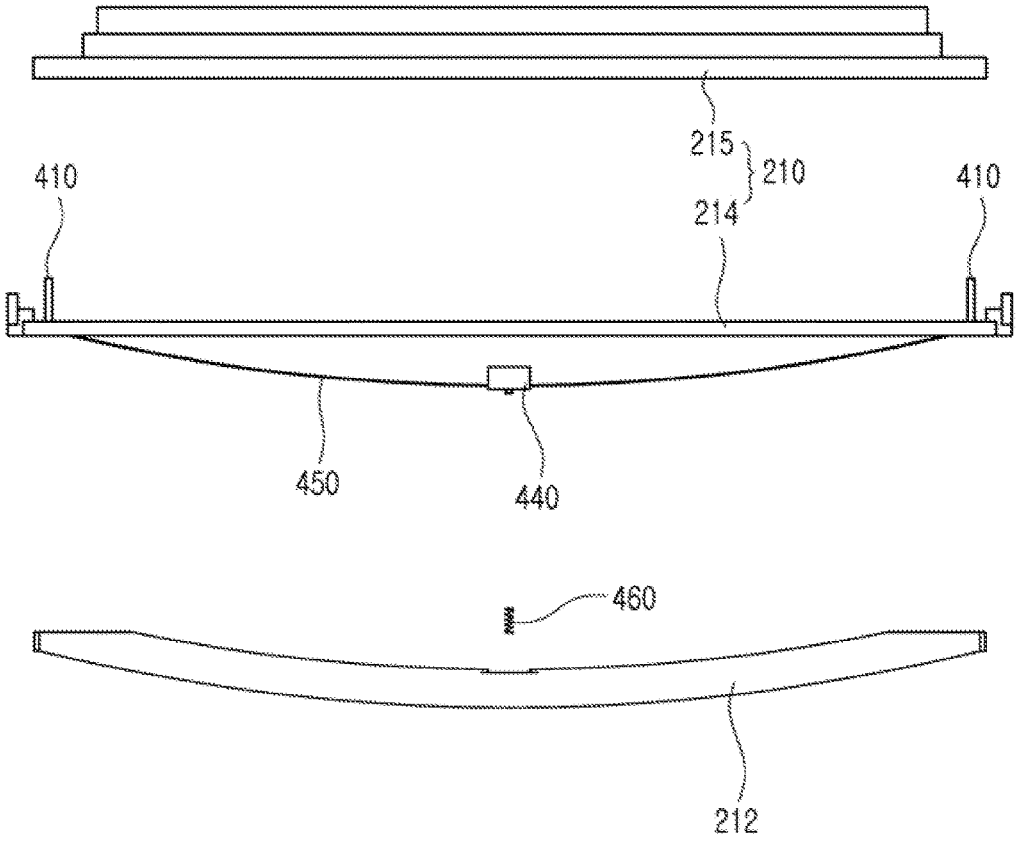
FIG. 8 is an exploded perspective view of the first individual door and the first handle of the oven of FIG. 1.
Figure 9:
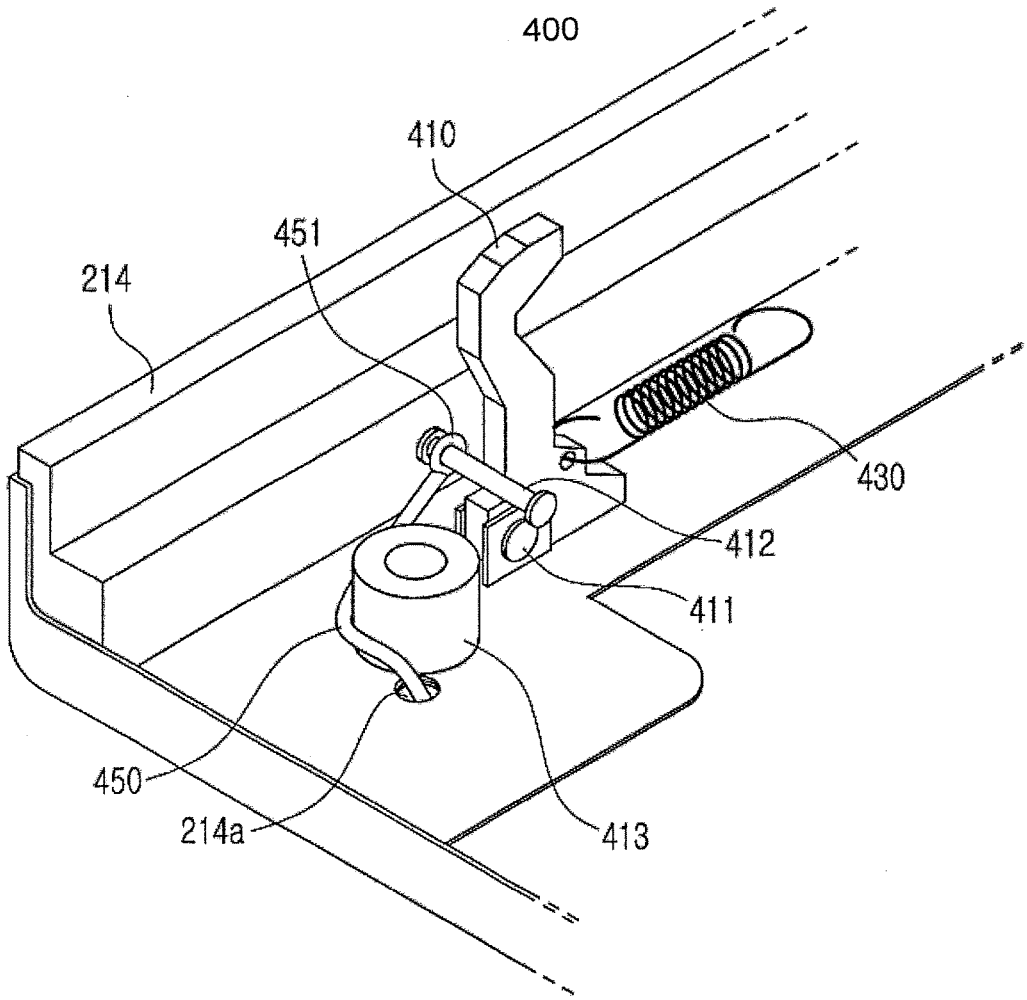
FIG. 9 is a view illustrating the structure of a first locking device of the oven of FIG. 1.

FIG. 1 is a view illustrating an oven in accordance with an embodiment of the present disclosure in a state in which a main door is closed, FIG. 2 is a view illustrating the oven of FIG. 1 in a state in which the main door is opened, FIG. 3 is a view illustrating the oven of FIG. 1 in a state in which a first individual door is opened, FIG. 4 is a view illustrating the oven of FIG. 1 in a state in which a second individual door is opened, FIG. 5 is a side view illustrating the oven of FIG. 1 in the state in which the second individual door is opened, FIG. 6 is a longitudinal-sectional view illustrating the oven of FIG. 1 in the state in which the second individual door is opened, FIG. 7 is a view illustrating the first individual door and a first handle of the oven of FIG. 1, FIG. 8 is an exploded perspective view of the first individual door and the first handle of the oven of FIG. 1, and FIG. 9 is a view illustrating the structure of a first locking device of the oven of FIG. 1.

With reference to FIGS. 1 to 9, an oven 1 in accordance with an embodiment of the present disclosure includes a main body 10, a cooking chamber 20 provided within the main body 10, and a heating device heating the cooking chamber 20. A display 11 displaying various pieces of cooking information and an operation panel 12 controlling a cooking process may be provided at the upper portion of the main body 10.

The cooking chamber 20 may have an approximately hexahedral shape, and may include an upper surface 21, a bottom surface 22, a rear surface 23, a left surface 24 and a right surface 25. The front surface of the cooking chamber 20 is opened so that food may be put into and taken out of the cooking chamber 20 through the opened front surface of the cooking chamber 20.

A sliding door 14 provided with a rear surface on which a closet is formed so as to receive various cooking utensils may be provided at the lower portion of the cooking chamber 20. The sliding door 14 may be slid forward and backward through a handle 15, thus being opened and closed.

The upper surface 21, the bottom surface 22, the rear surface 23, the left surface 24 and the right surface 25 of the cooking chamber 20 may form a cooking space 30. The cooking space 30 may be divided into a first individual cooking space 31 and a second individual cooking space 32 by a partition member 40.

The first individual cooking space 31 may be located above the second individual cooking space 32. Although an embodiment of the present disclosure describes the cooking space 30 as being divided into the first individual cooking space 31 and the second individual cooking space 32, embodiments of the present disclosure are not limited thereto, but the cooking space 30 may be divided into three or more individual cooking spaces.

The heating device may include a first heater 61 provided on the upper surface 21 of the cooking chamber 20, a second heater 62 provided on the bottom surface 22 of the cooking chamber 20, a third heater 63 provided on the rear surface 23 of the cooking chamber 20, and convection fans 71, 72 provided on the rear surface 23 of the cooking chamber 20.

The first heater 61 may be provided on the upper surface 21 of the cooking chamber 20 so as to be exposed to the outside, and heat the first individual cooking space 31. The second heater 62 may be provided on the bottom surface 22 so as not to be exposed to the outside, and thus be protected from food and oil generated from the food. The second heater 62 may heat the second individual cooking space 32. The third heater 63 may be provided on the rear surface 23 of the cooking chamber 20 to additionally heat the first individual cooking space 31 or the second individual cooking space 32.

The convection fans 71 and 72 may include a first convection fan 71 circulating air of the first individual cooking space 31, and a second convection fan 72 circulating air of the second individual cooking space 32.

Supporters 41 and 42 supporting the partition member 40 and a rack 50 may be provided on both side surfaces 24 and 25, and the partition member 40 and the rack 50 may be put on the supporters 41 and 42 and thus detachably arranged in the cooking chamber 20.

The partition member 40 is formed of a material thermally insulating the first individual cooking space 31 and the second individual cooking space 32 from each other, differently from the rack 50. The cooking space 30 of the cooking chamber 20 may be divided into the first individual cooking space 31 and the second individual cooking space 32 by arranging the partition member 40 in the cooking chamber 20.

Through such a structure, the oven 1 in accordance with an embodiment of the present disclosure may be operated in a total of four cooking modes. That is, the oven 1 may be operated in a first mode in which the entirety of the cooking space 30 is operated when the partition member 40 is not installed, a second mode in which the first individual cooking space 31 and the second individual cooking space 32 are operated when the partition member 40 is installed, a third mode in which only the first individual cooking space 31 is operated and the second individual cooking space 32 is not operated when the partition member 40 is installed, and a fourth mode in which the first individual cooking space 31 is not operated and only the second individual cooking space 32 is operated when the partition member 40 is installed.

In the respective modes, the heaters 61, 62 and 63 and the convection fans 71 and 72 may be independently controlled. For example, all the heaters 61, 62 and 63 and the all the convection fans 71 and 72 may be operated in the first mode and the second mode, only the first heater 61 and the first convection fan 71 may be operated in the third mode, and only the second heater 62, the third heater 63 and the second convection fan 72 may be operated in the fourth mode.

Further, the oven 1 includes a door assembly 90 opening and closing the opened front surface of the cooking space 30. The door assembly 90 of the oven 1 in accordance with an embodiment of the present disclosure is provided to selectively open and close the opened front surface of the entirety of the cooking space 30, the opened front surface of the first individual cooking space 31 or the opened front surface of the second individual cooking space 32.

The door assembly 90 may include a main door 100 rotatably combined with the main body 10, a first individual door 210 rotatably combined with the main door 100, and a second individual door 220 rotatably combined with the main door 100.

In more detail, the lower portion of the main door 100 may be combined with the main body 10 by main hinge devices 300 so that the main door 100 may be rotated in the upward and downward directions. The main door 100 may include a first horizontal frame 131, a second horizontal frame 132, a third horizontal frame 133, a first vertical frame 141, and a second vertical frame 142.

A first opening 110 corresponding to the first individual cooking space 31 may be formed between the first horizontal frame 131 and the second horizontal frame 132, and a second opening 120 corresponding to the second individual cooking space 32 may be formed between the second horizontal frame 132 and the third horizontal frame 133.

Therefore, a user may approach the first individual cooking space 31 through the first opening 110 even when the main door 100 is closed, and approach the second individual cooking space 32 through the second opening 120 even when the main door 100 is closed.

The first individual door 210 and the second individual door 220 may be rotatably combined with the main door 100 so as to respectively open and close the first opening 110 and the second opening 120.

A first handle 212 to open the first individual door 210 or the main door 100 and a viewing window 211 to see through the inside of the first individual door 210 may be provided on the first individual door 210.

A second handle 222 to open the second individual door 220 and a viewing window 221 to see through the inside of the second individual door 220 may be provided on the second individual door 220.

The first individual door 210 may be rotatably combined with the main door 100 by first hinge devices 213, and the second individual door 220 may be rotatably combined with the main door 100 by second hinge devices 223. The first hinge devices 213 and the second hinge devices 223 are respectively combined with the lower portions of the first individual door 210 and the second individual door 220, and thus the first individual door 210 and the second individual door 220 may be rotated in the upward and downward directions.

A main sealing member 30 (in FIG. 2) to hermetically seal the main door 100 and the cooking space 30 may be installed on a front plate 13 of the main body 10, a first sealing member 151 (in FIG. 3) to hermetically seal the first individual door 210 and the first opening 110 may be installed on the rear surface of the first individual door 210, and a second sealing member 152 (in FIG. 4) to hermetically seal the second individual door 220 and the second opening 120 may be installed on the rear surface of the second individual door 220.

Of course, the positions of the main sealing member 80, the first sealing member 151 and the second sealing member 152 are not limited thereto, and the main sealing member 80, the first sealing member 151 and the second sealing member 152 may be installed at proper positions to seal.

Therefore, the main sealing member 80 may be installed on the rear surface of the main door 100 rather than the front plate 13 of the main body 10, the first sealing member 151 may be installed on the front surface of the main door 100 rather than the rear surface of the first individual door 210, and the second sealing member 152 may be installed on the front surface of the main door 100 rather than the rear surface of the second individual door 220.

The main hinge devices 300 may elastically bias the main door 100 in a closing direction. Therefore, the main door 100 maintains a closed state when external force is not applied to the main door 100, and in order to open the main door 100, the main door 100 needs to be rotated by a predetermined force.

For example, the main hinge device 300, as shown in FIGS. 5 and 6, includes a hinge bracket 310 fixed to the main body 10, a hinge housing 302 provided on the main door 100, a slide member 330 sliding at the lower portion of the main door 100, and an elastic member 340 arranged in the hinge housing 320 to elastically support the slide member 330.

The hinge bracket 310 may be inserted into the main door 100 through a passage hole 323 formed on the rear surface of the main door 100. The hinge bracket 310 may be provided with a cam surface 311.

The hinge housing 320 may include a first support bar 321 with which one end portion 341 of the elastic member 340 is combined, and a guide bar 322 to guide movement of the slide member 330.

The slide member 330 may include a roller 333 to move along the cam surface 311, a second support bar 331 with which the other end portion 342 of the elastic member 340 is combined, and a guide hole 332 to guide the guide bar 322.

Through the above configuration, when the main door 100 is rotated in the downward direction, the roller 333 of the slide member 330 moves from a starting point 311*a* of the cam surface 311 of the hinge bracket 310 to a destination point 311*b* via an inflection point. At this time, the slide member 330 moves in the downward direction against elastic force of the elastic member 340.

When the main door 100 is rotated by a predetermined force sufficient to slide the slide member 330 against elastic force of the elastic member 340, the main door 100 may be opened. When such a predetermined force is not applied, the main door 100 is locked in the closed state by elastic force of the elastic member 340.

Therefore, the main hinge devices 300 of the main door 100 rotatably support the main door 100, and lock the main door 100 with the main body 10 while elastically biasing the main door 100 in the closing direction.

Thereby, when the first individual door 210 and the second individual door 220 are opened, the main door 100 is not opened and may maintain the closed state.

The first individual door 210 and the second individual door 220 are locked with the main door 100 by separate locking devices. Therefore, when the main door 100 or the second individual door 220 is opened, the first individual door 210 is not opened and may maintain the closed state, and when the main door 100 or the first individual door 210 is opened, the second individual door 220 is not opened and may maintain the closed state.

First, the configuration of a second locking device 500 to lock the second individual door 220 with the main door 100 will be described. As shown in FIG. 6, the second locking device 500 may include hook members 510 provided on the second individual door 220, holes 520 (in FIG. 4) provided on the main door 100 so that the hook members 510 may be inserted and locked in the holes 520, and elastic members 530 elastically biasing the hook members 510 to lock the hook members 510 with the holes 420.

Further, as shown in FIGS. 7 to 9, a first locking device 400 to lock the first individual door 210 with the main door 100 includes hook members 410 rotatably provided on the first individual door 210, holes 420 (in FIG. 3) provided on the main door 100 so that the hook members 410 may be inserted and locked with the holes 420, first elastic members 430 elastically biasing the hook members 410 to lock the hook members 410 with the holes 420, a opening member 440 provided on the handle 212 of the first individual door 210 so as to rotate the hook members 410 in a releasing direction of the locking of the hook members 410 to the holes 420, connection members 450 to connect the opening member 440 to the hook members 410 so as to rotate the hook members 410 when the opening member 440 is pressed, and a second elastic member 460 provided on the handle 212 of the first individual door 210 so as to return the opening member 440 to the original position thereof when pressing of the opening member 440 is released.

Here, the connection members 450 may be, for example, wires. End portions 451 of the connection member 450 may be combined with the opening member 440 provided on the handle 212 and a connection member combining bar 412 formed on the hook member 410 via a passage hole 214*a* formed on a front plate 214 of the first individual door 210.

The first individual door 210 may be formed by assembling the front plate 214 and a rear plate 215. Further, the connection member combining bar 412 with which the connection member 450 is combined so as to rotate the hook member 410 may be formed integrally with the hook member 410, or be fixed to the hook member 410 so that the connection member combining bar 412 may be rotated together with the hook member 410.

Support protrusions 413 may be formed on the front plate 214 of the first individual door 210 and support the connection members 450. The hook member 410 may be rotated about a rotary shaft 411.

Through such a configuration, when the opening member 440 is not pressed, the hook members 410 of the first individual door 210 are elastically biased in a direction of locking the hook members 410 to the holes 420 of the main door 100 by elastic force of the first elastic members 430, and then, the locked state of the first individual door 210 with the main door 100 may be maintained.

On the other hand, when the opening member 440 is pressed, the connection members 450 are pulled, the hook members 410 are rotated, and thus locking of the first individual door 210 with the main door 100 may be released.

Due to such a configuration, using only the first handle 212 provided on the first individual door 210, the first individual door 210 or the main door 100 may be selectively opened and closed.

That is, when the first handle 212 is pulled when the opening member 440 provided on the first handle 212 is not pressed, the first individual door 210 is locked with the main door 100 and thus the main door 100 may be opened, and when the first handle 212 is pulled when the opening member 440 provided on the first handle 212 is pressed, locking of the first individual door 210 with the main door 100 is released and thus the first individual door 210 may be opened.

Figure 10:
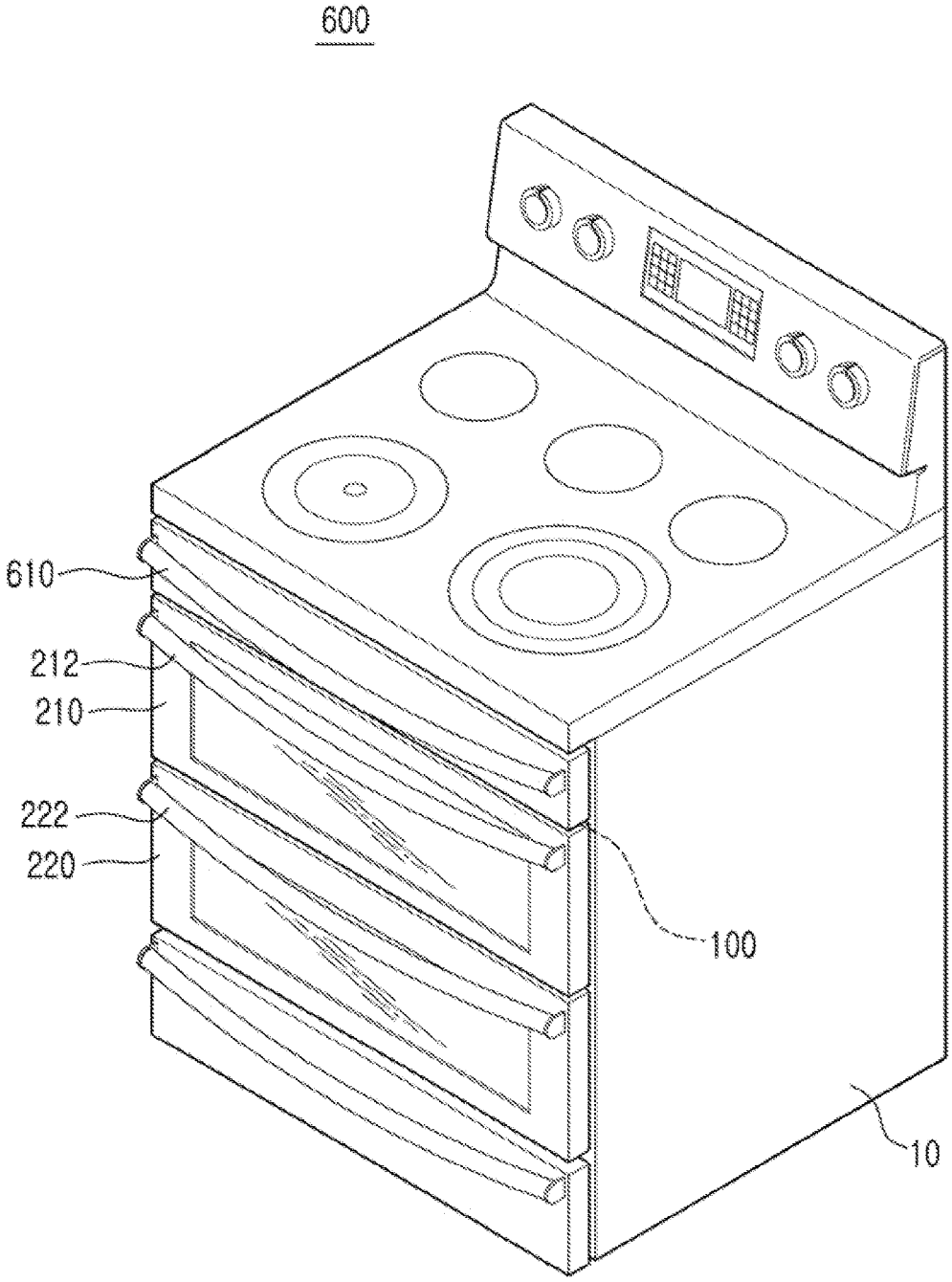
FIG. 10 is a view illustrating an oven in accordance with another embodiment of the present disclosure.
Figure 11:
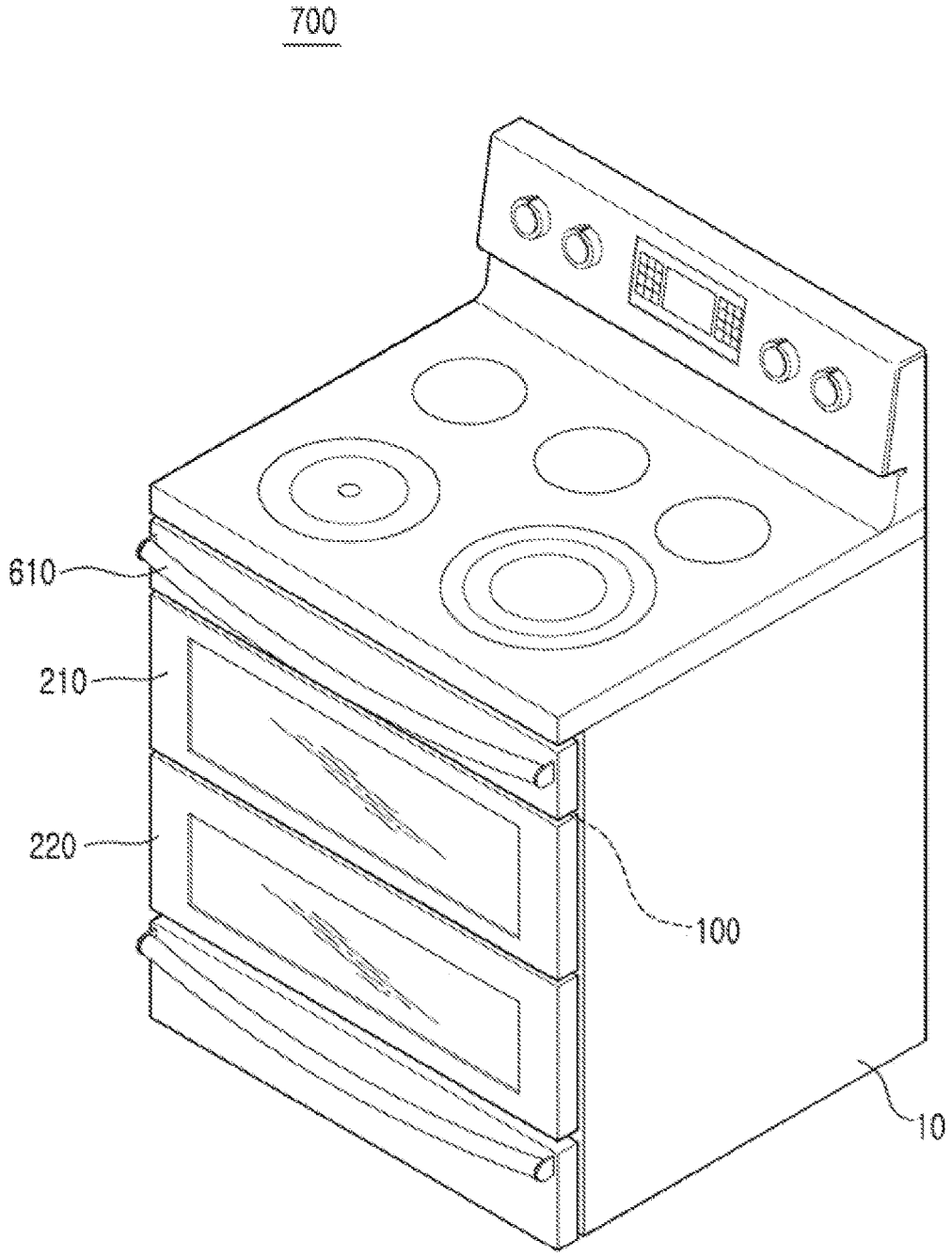
FIG. 11 is a view illustrating an oven in accordance with yet another embodiment of the present disclosure.

FIG. 10 is a view illustrating an oven in accordance with another embodiment of the present disclosure, and FIG. 11 is a view illustrating an oven in accordance with yet another embodiment of the present disclosure.

Hereinafter, with reference to FIGS. 10 and 11, ovens in accordance with embodiments of the present disclosure will be described. Some parts in these embodiments which are substantially the same as those in an embodiment shown in FIGS. 1 to 9 are denoted by the same reference numerals or the reference numerals of these parts are omitted even though they are depicted in different drawings and a detailed description thereof will thus be omitted because it is considered to be unnecessary.

An oven 600 in accordance with an embodiment shown in FIG. 10 may further include a separate handle 610 opening and closing a main door 100, as compared to the oven 1 in accordance with an embodiment shown in FIGS. 1 to 9. Therefore, the oven 600 may include the main handle 610 opening and closing the main door 100, a first handle 212 opening and closing a first individual door 210, and a second handle 222 opening and closing a second individual door 220.

The oven 600 is the same as the oven 1 in accordance with an embodiment shown in FIGS. 1 to 9 in that the main door 100 is rotatably combined with a main body 10 and includes a first opening corresponding to a first individual cooking space and a second opening corresponding to a second individual cooking space, the first individual door 210 is rotatably combined with the main door 100 so as to open and close the first opening, and the second individual door 220 is rotatably combined with the main door 100 so as to open and close the second opening.

Further, the oven 600 is the same as the oven 1 in accordance with an embodiment shown in FIGS. 1 to 9 in that the main door 100 is locked with the main door 10 and the first individual door 210 and the second individual door 220 are locked with the main door 100 so that, when one of the respective doors 100, 210 and 220 is opened, the others of the respective doors 100, 210 and 220 are not opened, and sealing members are provided between the main door 100 and the main body 10, between the first individual door 210 and the main door 100 and between the second individual door 220 and the main door 100.

Here, the handles 610, 212 and 222 are not limited to the shape shown in FIG. 10, but may have any shape provided to open and close the respective doors 100, 210 and 220.

In an oven 700 in accordance with an embodiment shown in FIG. 11, a handle 610 may be provided only on a main door 100, and no handle may be provided on a first individual door 210 and a second individual door 220.

Since the first individual door 210 and the second individual door 220 have a relatively smaller weight than the main door 100, the first individual door 210 and the second individual door 220 may have a locking structure in which the first individual door 210 or the second individual door 220 is automatically opened when the upper end portion of the first individual door 210 or the second individual door 220 is slightly pushed in the same manner as a home bar door of a refrigerator, and a separate handle may not be provided on the first individual door 210 and the second individual door 220.

The conventional technique, as disclosed in Korean Patent Publication No. 10-2004-0004647, may be applied to such an automatic opening structure, and a detailed description thereof will thus be omitted.

The oven 700 is the same as the oven 1 in accordance with an embodiment shown in FIGS. 1 to 9 in that the main door 100 is rotatably combined with a main body 10 and includes a first opening corresponding to a first individual cooking space and a second opening corresponding to a second individual cooking space, the first individual door 210 is rotatably combined with the main door 100 so as to open and close the first opening, and the second individual door 220 is rotatably combined with the main door 100 so as to open and close the second opening.

Further, the oven 700 is the same as the oven 1 in accordance with an embodiment shown in FIGS. 1 to 9 in that the main door 100 is locked with the main door 10 and the first individual door 210 and the second individual door 220 are locked with the main door 100 so that, when one of the respective doors 100, 210 and 220 is opened, the others of the respective doors 100, 210 and 220 may not be opened, and sealing members are provided between the main door 100 and the main body 10, between the first individual door 210 and the main door 100 and between the second individual door 220 and the main door 100.

Figure 12:
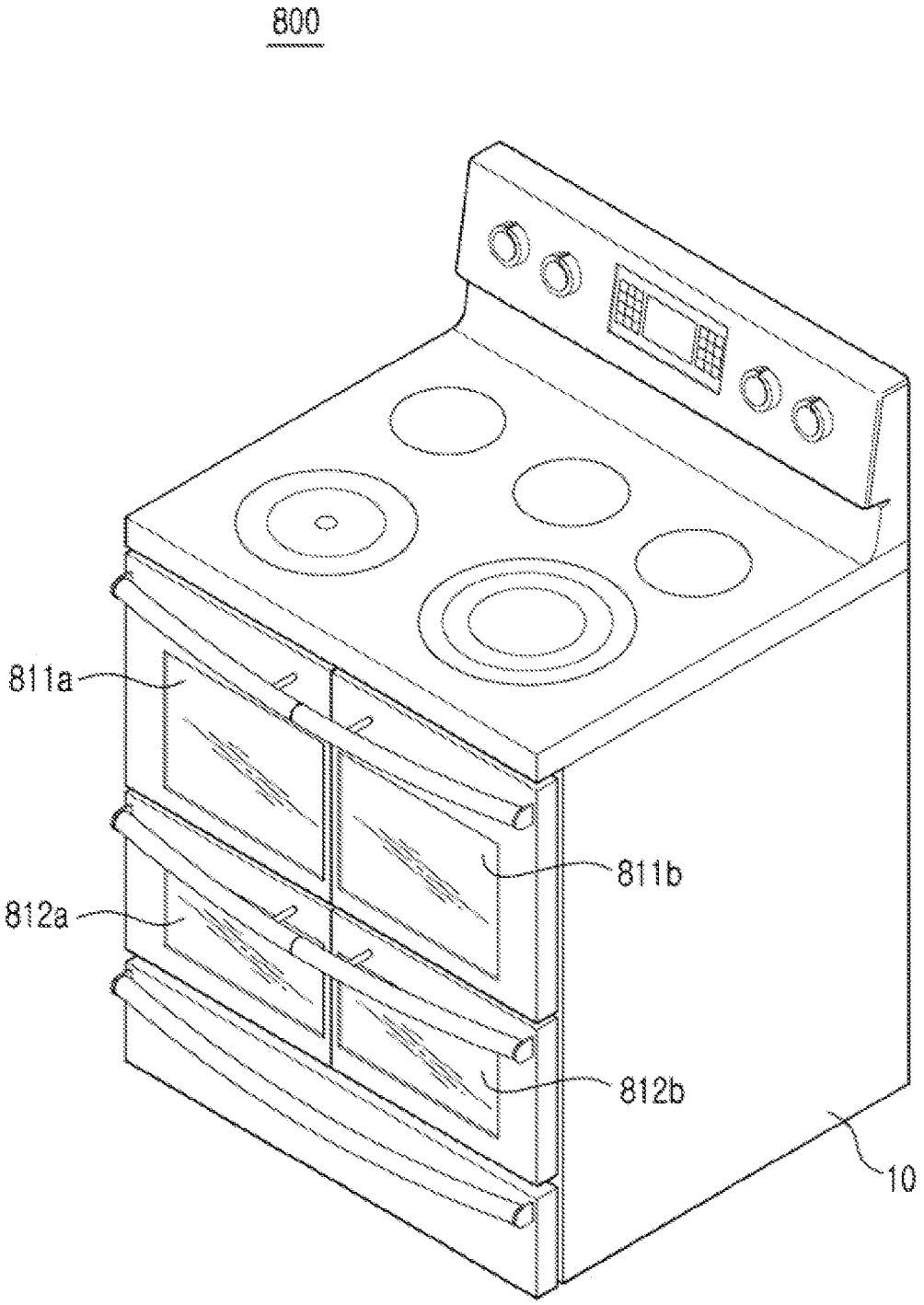
FIG. 12 is a view illustrating an oven in accordance with a further embodiment of the present disclosure.

FIG. 12 is a view illustrating an oven in accordance with a further embodiment of the present disclosure.

With reference to FIG. 12, an oven 800 in accordance with an embodiment of the present disclosure has a cooking space dividable into a first individual cooking space and a second individual cooking space by a detachable partition member in the same manner as embodiments.

Differently from embodiments, the oven 800 in accordance with an embodiment includes a plurality of first doors 811*a* and 811*b* combined with both sides of the main body 10 and rotatable in the leftward and rightward directions so as to open and close the first individual cooking space, and a plurality of second doors 812*a* and 812*b* combined with both sides of the main body 10 and rotatable in the leftward and rightward directions so as to open and close the second individual cooking space.

The first doors 811*a* and 911*b* and the second doors 812*a* and 912*b* may be individually opened and closed. For example, one of the first doors 811*a* and 811*b* opens and closes at least a portion of the first individual cooking space, and the other of the first doors 811*a* and 811*b* opens and closes the remaining portion of the first individual cooking space. Further, one of the second doors 812*a* and 812*b* opens and closes at least a portion of the second individual cooking space, and the other of the second doors 812*a* and 812*b* opens and closes the remaining portion of the second individual cooking space.

Therefore, the plurality of first doors 811*a* and 811*b* and the plurality of second doors 812*a* and 812*b* may be opened and closed in the first mode in which the entirety of the cooking space is operated when the partition member is separated from the man body 10 and in the second mode in which the first individual cooking space and the second individual cooking space are operated when the partition member is installed on the main body 10.

Further, in the third mode in which the second individual cooking space is not operated and only the first individual cooking space is operated when the partition member is installed on the main body 10, only the plurality of first doors 811*a* and 811*b* may be opened and closed while the plurality of second doors 812*a* and 812*b* is closed.

Further, in the fourth mode in which the first individual cooking space is not operated and only the second individual cooking space is operated when the partition member is installed on the main body 10, only the plurality of second doors 812*a* and 812*b* may be opened and closed while the plurality of first doors 811*a* and 811*b* is closed.

Therefore, when only some of the individual cooking spaces are operated, all of the doors 811*a*, 811*b*, 812*a* and 812*b* need not be opened and closed, and some of the doors 811*a*, 811*b*, 812*a* and 812*b* may be opened and closed so as to put/take food into/out of the oven 800.

As is apparent from the above description, in an oven in accordance with an embodiment of the present disclosure which has a cooking space dividable into a plurality of individual cooking spaces, the entirety of the cooking space or the individual cooking spaces may be selectively opened and closed by a door assembly.

Therefore, since the door assembly may be opened and closed according to using states of the cooking space, the oven may be conveniently used and particularly, a heat loss or danger of burn generated due to opening and closing a main door when only the individual cooking space is used may be prevented.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An oven comprising:

a main body;

a cooking chamber provided within the main body and including a cooking space;

a partition member to divide the cooking space into a first individual cooking space and a second individual cooking space;

a main door rotatably coupled to the main body to open and close the cooking space, the main door including:

a first main door opening corresponding to the first individual cooking space;

a second main door opening corresponding to the second individual cooking space;

a first individual door rotatably coupled to the main door to individually open and close the first main door opening with respect to the main door; and a second individual door rotatably coupled to the main door to individually open and close the second main door opening with respect to the main door;

a first locking member to lock the first individual door to the main door; and a first handle to open or close the main door or to open or close the first individual door, the first handle including an opening member to unlock the first locking member so that when the opening member is pressed, only the first individual door is openable while the main door remained closed, and when the opening member is unpressed, the first locking member remained locked so that the first individual door is not openable but the main door is openable, wherein when the main door is opened, both the first individual cooking space and the second individual cooking space are accessible, and wherein when the main door is closed, the first individual door is individually open and close with respect to the main door so that the first individual cooking space is accessible and the second individual door is individually open and close with respect to the main door so that the second individual cooking space is accessible.

2. The oven according to claim 1, wherein the partition member is attachable to or detachable from the cooking space.

3. The oven according to claim 2, wherein:

a first mode in which an entire cooking space is operated when the partition member is separated from the cooking space, a second mode in which the first individual cooking space and the second individual cooking space are operated when the partition member is installed in the cooking space, a third mode in which only the first individual cooking space is operated and the second individual cooking space is not operated when the partition member is installed in the cooking space, and a fourth mode in which the first individual cooking space is not operated and only the second individual cooking space is operated when the partition member is installed in the cooking space are prepared; and the main door is opened and closed when the first individual door and the second individual door are closed in the first mode, the main door is opened and closed when the first individual door and the second individual door are closed or the first individual door and the second individual door are opened and closed when the main door is closed in the second mode, the first individual door is opened and closed when the main door and the second individual door are closed in the third mode, and the second individual door is opened and closed when the main door and the first individual door are closed in the fourth mode.

4. The oven according to claim 1, further comprising:

a main sealing member closely adhered to the main body and the main door so as to hermetically seal the cooking space;

a first sealing member closely adhered to the main door and the first individual door so as to hermetically seal the first opening; and a second sealing member closely adhered to the main door and the second individual door so as to hermetically seal the second opening.

5. The oven according to claim 1, further comprising:

a plurality of main hinge members to rotatably couple the main door to the main body;

a plurality of first members to rotatably couple the first individual door to the main door; and a plurality of second hinge members to rotatably couple the second individual door to the main body.

6. The oven according to claim 1, further comprising:

a second locking member to lock the second individual door with the main door.

7. The oven according to claim 6, wherein:

the first handle is provided on the first individual door;

a second handle is provided on the second individual door;

when the opening member is unpressed and the first handle is pulled, the main door is opened, and when the opening member is pressed and the first handle is pulled, the first individual door is opened; and when the second handle is pulled, the second individual door is opened.

8. The oven according to claim 6, wherein;

when the second individual door is pushed at a second predetermined force, the second individual door is opened.

9. The oven according to claim 6, wherein;

the first handle is provided on the first individual door;

a second handle is provided on the second individual door;

when the first handle is pulled when the first individual door is locked with the main door, the main door is opened;

when the first handle is pulled when the first individual door is unlocked with the main door, the first individual door is opened; and when the second handle is pulled, the second individual door is opened.

10. The oven according to claim 9, wherein the first locking member includes:

a plurality of hook members rotatably provided on the first individual door;

a plurality of holes provided on the main door so as to correspond to the plurality of hook members;

a plurality of first elastic members to elastically bias the plurality of hook members to be inserted and locked with the plurality of holes;

the opening member provided on the first handle so as to rotate the plurality of hook members in a releasing direction of the locking of the plurality of hook members to the plurality of holes;

connection members to connect the opening member to the plurality of the plurality of hook members so as to rotate the plurality of hook members when the opening member is pressed; and a second elastic member provided on the first handle so as to return the opening member to the original position thereof when pressing of the opening member is released, wherein, when the opening member is not pressed, the first individual door is locked with the main door, and, when the opening member is pressed, the first individual door is unlocked with the main door.

11. The oven according to claim 10, wherein the connection members are wires.

12. An oven comprising:

a main body;

a cooking chamber formed in the main body and including a cooking space;

a partition member to divide the cooking space into a plurality of individual cooking spaces;

a main door rotatably coupled to the main body so as to open and close an opened front surface of the cooking space, the main door including:

a plurality of main door openings respectively corresponding to the plurality of individual cooking spaces; and a plurality of individual doors rotatably coupled to the main door so as to respectively open and close the plurality of main door openings, the plurality of individual doors including a first individual door;

a first locking member to lock the first individual door to the main door; and a first handle to open or close the main door or to open or close the first individual door, the first handle including an opening member to unlock the first locking member so that when the opening member is pressed, only the first individual door is openable while the main door remained closed, and when the opening member is unpressed, the first locking member remained locked so that the first individual door is not openable but the main door is openable, wherein when the main door is opened, each of the plurality of individual cooking spaces corresponding to the plurality of main door openings is accessible, and wherein when the main door is closed, the plurality of individual doors is individually open and close with respect to the main door so that the plurality of individual cooking spaces corresponding to the plurality of individual doors is individually accessible.

13. The oven according to claim 1, wherein the first and second individual doors are configured to be individually opened and closed when the main door is closed, and the main door is configured to be opened and closed when the first and second individual doors are closed.

* * * * *